US009357895B2

(12) United States Patent
Leifheit et al.

(10) Patent No.: US 9,357,895 B2
(45) Date of Patent: Jun. 7, 2016

(54) GRAVITY FEED SOLUTION DISTRIBUTION SYSTEM

(71) Applicant: Karcher North America, Inc., Englewood, CO (US)

(72) Inventors: Todd Leifheit, Littleton, OH (US); Steven Tucker, Centennial, CO (US)

(73) Assignee: Kärcher North America, Inc., Englewood, CO (US)

( * ) Notice: Subject to any disclaimer, the term of this patent is extended or adjusted under 35 U.S.C. 154(b) by 128 days.

(21) Appl. No.: 14/154,846

(22) Filed: Jan. 14, 2014

(65) Prior Publication Data

US 2014/0196230 A1 Jul. 17, 2014

Related U.S. Application Data

(60) Provisional application No. 61/752,227, filed on Jan. 14, 2013.

(51) Int. Cl.
*A47L 11/18* (2006.01)
*A47L 11/40* (2006.01)

(52) U.S. Cl.
CPC ..... *A47L 11/4088* (2013.01); *A47L 11/4041* (2013.01); *A47L 11/185* (2013.01)

(58) Field of Classification Search
CPC ..... A47L 11/4088; A47L 11/4041; A47L 11/125; A47L 11/145; A47L 11/165; A47L 11/282; A47L 11/408; A47L 11/185; A47L 11/18
USPC ..... 15/50.1, 50.3
See application file for complete search history.

(56) References Cited

U.S. PATENT DOCUMENTS

| | | | |
|---|---|---|---|
| 1,297,694 | A | 3/1919 | Kindling |
| 3,702,488 | A | 11/1972 | Kasper |
| 3,879,789 | A | 4/1975 | Kasper |
| 4,307,484 | A | 12/1981 | Williams |
| 4,385,413 | A | 5/1983 | Goldsmith |
| 5,505,915 | A | 4/1996 | Copeland et al. |
| 5,993,563 | A | 11/1999 | Strickland et al. |
| 6,030,465 | A | 2/2000 | Marcussen et al. |
| 6,463,616 | B1 | 10/2002 | Morokutti |

(Continued)

FOREIGN PATENT DOCUMENTS

| | | |
|---|---|---|
| WO | WO 96/26115 | 8/1996 |
| WO | WO 99/56607 | 11/1999 |

OTHER PUBLICATIONS

International Search Report and Written Opinion for International (PCT) Patent Application No. PCT/US14/11421, mailed May 13, 2014 10 pages.

(Continued)

*Primary Examiner* — Laura C Guidotti
(74) *Attorney, Agent, or Firm* — Sheridan Ross P.C.

(57) ABSTRACT

A gravity feed solution distribution system for use with surface maintenance and conditioning machines includes front and rear counter-rotating brush rollers within a shroud, a manifold having delivery ports and disposed within the shroud above the counter-rotating brush rollers, an agitating blade extending from an inner surface of the shroud and underneath the manifold to contact the front counter-rotating brush roller, and a baffle extending downward from an inner surface of the shroud above the front counter-rotating brush roller to contact the front counter-rotating brush roller.

17 Claims, 8 Drawing Sheets

(56) References Cited

U.S. PATENT DOCUMENTS

| | | | | |
|---|---|---|---|---|
| 6,721,990 | B2 | 4/2004 | Zahuranec et al. | |
| 6,964,081 | B1 | 11/2005 | Clement et al. | |
| 7,056,384 | B2 * | 6/2006 | Davis et al. | 118/207 |
| 7,137,170 | B1 | 11/2006 | Morey et al. | |
| 7,228,590 | B2 | 6/2007 | Bosses | |
| 7,228,591 | B2 | 6/2007 | Bosses | |
| 7,272,870 | B2 | 9/2007 | Pierce et al. | |
| 7,302,733 | B2 | 12/2007 | Rau et al. | |
| 7,488,391 | B2 | 2/2009 | Hansen | |
| 7,533,435 | B2 | 5/2009 | Pedlar et al. | |
| 7,849,556 | B1 | 12/2010 | Jansen | |
| 7,967,914 | B2 * | 6/2011 | Giddings et al. | 134/6 |
| 8,016,996 | B2 | 9/2011 | Field et al. | |
| 8,025,786 | B2 | 9/2011 | Field et al. | |
| 8,028,365 | B2 | 10/2011 | Field et al. | |
| 8,528,142 | B1 | 9/2013 | Pedlar et al. | |
| 2002/0194692 | A1 | 12/2002 | Giddings et al. | |
| 2003/0159232 | A1 | 8/2003 | Hekman et al. | |
| 2003/0163888 | A1 | 9/2003 | Joo et al. | |
| 2005/0005389 | A1 | 1/2005 | Rau et al. | |
| 2005/0246853 | A1 | 11/2005 | Pierce et al. | |
| 2006/0048331 | A1 | 3/2006 | Rau et al. | |
| 2006/0075595 | A1 | 4/2006 | Bosses | |
| 2006/0075596 | A1 | 4/2006 | Bosses | |
| 2006/0156498 | A1 | 7/2006 | Venard et al. | |
| 2010/0212688 | A1 | 8/2010 | Goff | |
| 2012/0291218 | A1 | 11/2012 | Pedlar et al. | |

OTHER PUBLICATIONS

International Preliminary Report on Patentability for International (PCT) Patent Application No. PCT/US2014/011421, mailed Jul. 23, 2015 9 pages.

US 7,959,788, 06/2011, Field et al. (withdrawn)

* cited by examiner

GRAVITY FEED SOLUTION DISTRIBUTION SYSTEM

This U.S. Non-Provisional Patent Application claims the benefit of priority to U.S. Provisional Patent Application No. 61/752,227, filed Jan. 14, 2013, the entire disclosure of which is hereby incorporated by reference in its entirety.

FIELD OF THE INVENTION

The present disclosure relates generally to surface maintenance or conditioning machines, and more particularly to such machines that employ a liquid cleaning solution to perform a cleaning task.

BACKGROUND OF THE INVENTION

Surface maintenance or condition machines—such as extractors—that use a cleaning liquid to clean a carpet, upholstery, or like surfaces are well known in the art. A conventional extractor generally includes a cleaning liquid delivery system including a container for holding the cleaning liquid, a rotating brush or a revolving scrubber for scrubbing the surface to be cleaned, and a gravity feed or pump for delivering the cleaning liquid to the surface. The conventional extractor also includes a cleaning liquid recovery system having a recovery nozzle, a suction generating device (such as a motor driven fan), and a dirty cleaning liquid recovery tank. Such extractors are more effective than typical vacuum cleaners due to their ability to loosen ground in dirt by the action of the rotating brush or revolving scrubber in conjunction with application of the cleaning liquid.

Known surface maintenance or condition machines suffer from various drawbacks. For example, many extractors leave excess amounts of cleaning liquid on the surface being cleaned, which must then be dried for an undesirable length of time. Excessive surface wetting may promote the growth of fungus and/or bacteria on or within the surface, especially when the surface is carpet. Additionally, over-wetting may cause surface stains to appear or reappear on the surface; this might occur, for example, as underlying soil or stains migrate upward through carpet until visible on the carpet surface. Some surface maintenance or condition machines also provide an uneven distribution of fluid across the surface to be cleaned, resulting in uneven cleaning of the surface and, in some cases, streaks on the surface.

Additionally, many surface maintenance or conditioning machines use pumps or spray jets to convey cleaning liquid from a cleaning liquid storage tank either to the surface itself or to a scrub brush or pad used to agitate and clean the surface. Such devices increase both the purchase cost and the complexity of the extractors in which they are used, require increased maintenance, and introduce additional failure modes.

Accordingly, there is a need for a cleaning liquid distribution system for use in surface maintenance or conditioning machines that evenly distributes an appropriate amount of cleaning fluid in an efficient, cost-effective, and low-maintenance manner.

SUMMARY OF THE INVENTION

Embodiments of the present disclosure achieve an even distribution of cleaning liquid without the use of pumps or spray jets. As a result, the system described herein reduces the cost of the surface maintenance and conditioning machines in which it is used, is easier to use and maintain, is more reliable, and provides improved results.

An embodiment of the present disclosure includes (1) a shroud that is open on the bottom; (2) within the shroud, front and rear adjacent, counter-rotating brush rollers extending across substantially the entire width of the shroud and rotating about axes that are substantially horizontal and substantially parallel; (3) a manifold extending across substantially the entire width of the shroud, above the counter-rotating brush rollers; (4) an agitation blade extending across substantially the entire width of the shroud, the agitation blade attached to the shroud adjacent the manifold on a side proximal the rear counter-rotating brush roller and extending underneath the manifold to contact the front counter-rotating brush roller; and (5) a baffle extending across substantially the entire width of the shroud, the baffle attached to the shroud above the front counter-rotating brush roller and extending downward to contact the front counter-rotating brush roller. The agitation blade, the baffle, the shroud, and the front counter-rotating brush roller enclose a misting volume. In some embodiments, a dispersion strip is attached to the body of each counter-rotating brush roller and extends along the length thereof. In some embodiments, the front and rear counter-rotating brush rollers comprise end caps positioned at the axial end thereof, which facilitate the installation and removal of the front and rear counter-rotating brush rollers from the shroud.

In operation, gravity pulls cleaning liquid into the manifold from a cleaning liquid storage tank located above the shroud. Cleaning liquid drips from the manifold onto the agitation blade, which vibrates at high frequency due to its contact with the rotating front brush roller. These vibrations break each drop of cleaning liquid into fine droplets, which fill the misting volume and work their way into the bristles of the front brush roller. The baffle, agitation blade, and, when used, the dispersion strip all prevent drops of cleaning liquid from falling directly onto the surface being cleaned, and thus also prevent the undesirable streaks that result from such drops.

It is an object of the present disclosure to describe a cleaning liquid delivery system that, without using pumps or spray jets, achieves an even distribution of cleaning liquid across one or both of the counter-rotating brush rollers thereof, and further prevents cleaning liquid from dripping onto the surface being cleaned and causing undesirable streaks on the surface. Other objects and advantages of the present disclosure will become apparent to those skilled in the art upon a review of the following detailed description of the preferred embodiments and the accompanying drawings.

According to varying embodiments of the present disclosure, a gravity feed solution distribution system is disclosed.

BRIEF DESCRIPTION OF THE DRAWINGS

The accompanying drawings, which are incorporated in and constitute part of the specification, illustrate embodiments of the present disclosure and together with the general description of the gravity feed solution distribution system given above and the detailed description of the drawings given below, serve to explain embodiments of the present disclosure.

Figure 1:
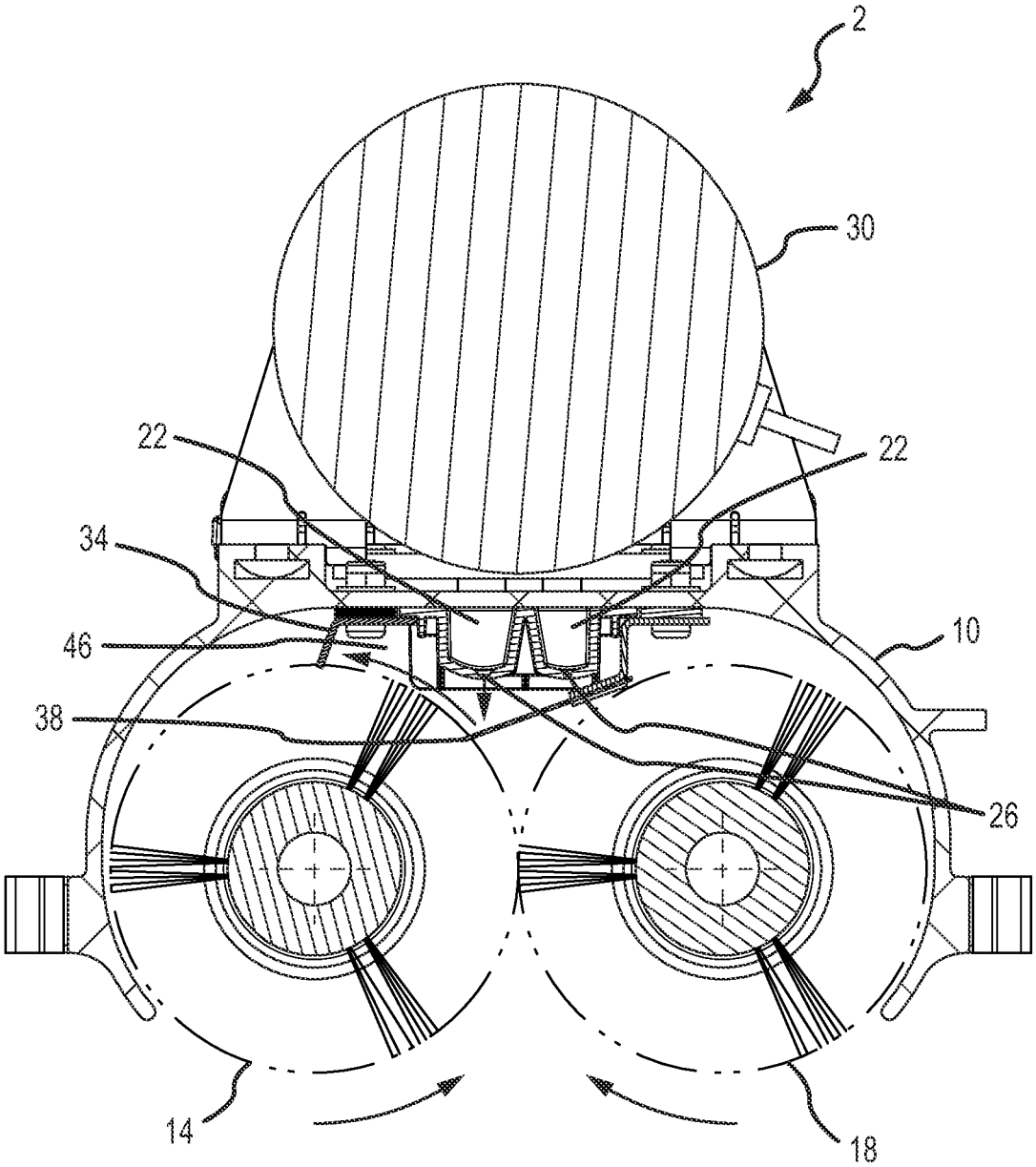
FIG. 1 is a cross-sectional elevation view of a surface cleaning device and solution distribution system according to an embodiment of the present disclosure.

It should be understood that the drawings are not necessarily to scale. In certain instances, details that are not necessary for an understanding of the disclosure or that render other details difficult to perceive may have been omitted from these drawings. It should be understood, of course, that the present disclosure is not limited to the particular embodiments illustrated in the drawings.

DETAILED DESCRIPTION

Varying embodiments of the present disclosure are described herein with reference to the drawings. It is expressly understood that although the figures depict one embodiment of a gravity feed solution distribution system, the present disclosure is not limited to that specific disclosed embodiment.

According to the present invention, referring to FIGS. 1-5, a surface cleaning device 2, which may comprise an extractor or extractor-type device for cleaning carpets, upholstery, or other surfaces has a shroud 10. Disposed within the shroud 10 are front and rear counter-rotating bristle brush rollers 14, 18, respectively. Brush rollers 14, 18 rotate around substantially parallel, substantially horizontal axes, and are rotatably supported at each axial end, such as by the shroud 10 or by interconnection to a chassis of the surface cleaning device 2. Persons of skill in the art will recognize that various mechanisms for rotatably mounting a brush roller to a support are known in the art. In some embodiments, brush rollers 14, 18 are equipped with end caps (not shown) at the axial ends thereof for rotatably mounting brush rollers 14, 18 to the shroud 10 or other portion of the cleaning device. In some embodiments, each brush roller 14, 18 rotates on a shaft (not shown) bridging between and supported by bearings fixedly attached to the sides of shroud 10 or a chassis component. The brush rollers 14, 18 are rotatably driven via pulleys, gears, or other known linkages by a drive motor 30 mounted to or otherwise associated with the surface cleaning device 2.

In certain embodiments, the brush rollers 14, 18 are of substantially the same diameter and their axes are separated by a distance substantially equal to that diameter. In other embodiments, the brush rollers 14, 18 are of different diameters, and/or are separated by more or less distance than the diameter of either brush roller 14, 18. The brush rollers 14, 18 partially extend out of the bottom of shroud 10 so as to engage a surface to be cleaned. In various embodiments, the positioning of the rollers, including the relative distance between the rollers 14, 18 and the relative distance between at least one roller and a surface to be cleaned is selectively adjustable by a user. Such adjustability may be particularly desirable where the texture, material, and height of carpets or surfaces to be cleaned is variable.

In some embodiments, mechanical agitators other than bristle brush rollers are provided. When bristle brush rollers 14, 18 are provided, as in the depicted embodiment, the bristles are preferably soft and are preferably arranged in a dense, well-distributed fill pattern. The bristles may be directly tufted or inserted into each brush roller 14, 18. Alternatively, the bristles may be held by means of a replaceable strip attached to the body of each brush roller 14, 18. Any other suitable mechanical agitator may be used, including, for example, resilient wiper blades or a series of resilient projecting elastomeric fingers.

The surface cleaning device 2 further comprises a manifold 22 that extends across substantially the entire transverse dimension of the shroud 10, parallel to brush rollers 14, 18. In the depicted embodiment, the manifold 22 is provided on the shroud 10 and preferably disposed vertically above brush rollers 14, 18, and preferably at a point in between the axes of brush rollers 14, 18. A series of delivery ports 26 are provided at spaced locations along the length of the manifold 22. The manifold 22 is in fluid communication with a cleaning liquid storage tank 9 of the surface cleaning machine 2, the tank being preferably located elsewhere on the machine at a position of greater gravitational potential energy than the manifold 22 such cleaning liquid from the cleaning liquid may be provided to the manifold 22 and rollers 14, 18 under the force of gravity. Cleaning liquid is distributed along the manifold 22 and provided to the delivery ports 26 inside the manifold 22, thus providing a substantially even distribution of cleaning liquid across a width of shroud 10 and/or rollers 14, 18. A valve is provided at one or more locations along the cleaning liquid flow path between the cleaning liquid storage tank and the manifold 22 for user-selected control of fluid flow. Such valve or control comprises the ability to completely restrict fluid flow to the manifold 22, and to allow various flow rates of fluid to the manifold. Various valves, including ball valves, gate valves, and various similar devices as will be recognized by one of skill in the art are suitable for providing this function along a fluid flow path of the cleaning fluid. In some embodiments, a solenoid valve is provided for this purpose, and in some embodiments, the opening and closing of the solenoid valve is controlled by circuitry adapted for that purpose, based on a setting selected by the operator of the surface maintenance or conditioning machine.

In some embodiments, two or more manifolds 22 are disposed in adjacent positions within the shroud 10. In such embodiments, each manifold 22 has a different flow rate due to variations in the size thereof, variation in the number of delivery ports 26 therein, and/or the size of delivery ports 26 therein. When two or more manifolds 22 are disposed in shroud 10, one or more valves are used to start and stop the flow to each manifold 22. This allows an operator to select an appropriate flow rate for a given application—i.e., a higher flow rate for a particularly dirty surface and a lower flow rate for a moderately dirty surface.

Also disposed within the shroud 10 is an agitation blade 38. In certain embodiment, the agitation blade 38 extends across substantially the entire transverse dimension or width of at least one of the rollers 14, 18. The agitation blade 38 is fixedly or removably attached to the shroud 10 adjacent manifold 22 and extends underneath the manifold 22 and contacts at least one brush roller 14, 18. When the at least one brush roller 14, 18 is caused to rotate, a contact between the bristles of the brush roller 14, 18 and the agitation blade 38 causes the agitation blade 38 to vibrate at high frequency. The agitation blade 38 preferably comprises a resilient material, such a metal, rubber, plastic, or other material with at least some capability of elastic deformation. The agitation blade 38 induces a misting effect on at least one of the rollers 14, 18 that increases the evenness of a distribution of the liquid that is gravity fed to the roller 14, 18. In the depicted embodiment, the agitation blade 38 is provided and arranged so as to act upon a first roller 14, with a second roller comprising an opposition direction of rotation. It will be expressly recognized, however, that the present invention is not limited to this particular arrangement. Indeed, it is contemplated that various alternative arrangements are provided, including those where the agitation blade 38 acts on the second roller 18 or both rollers 14, 18. In various embodiments, a preferred liquid or fluid distribution is provided. This distribution is provided by the provision and arrangement of the rollers 14, 18, the manifold 22, and the agitation blade 38.

In certain embodiments, a baffle 34 is provided. The baffle 34 extends across substantially the entire transverse or width dimension of the shroud 10, and is positioned to substantially contain a spray or fluid mist to the area immediately above the brush roller 14 and the outer radius of brush roller 14. The volume bounded by the shroud 10, brush roller 14, baffle 34, and agitation blade 38 comprises a misting volume 46. The baffle 34 prevents excess solution dispersed by agitating blade 38 that has not yet worked into brush roller 14 from collecting on the inner surface of the shroud and dripping onto the surface being cleaned, which could cause undesirable streaks or pooling on a carpet or surface to be cleaned. Cleaning liquid that reaches baffle 34 is redirected into brush roller 14 and/or back into the misting volume 46. Baffle 34 thus enhances the distribution of cleaning liquid over brush roller 14 for improved cleaning efficiency.

During operation of the gravity feed solution distribution system, a drive motor 30 causes brush rollers 14, 18 to counter-rotate in the direction shown in FIG. 1. Gravity pulls cleaning liquid from the cleaning liquid storage tank 9 into manifold 22, where it drips (also due to gravity) out of manifold 22 through delivery ports 26. The falling drops of cleaning liquid contact vibrating agitation blade 38, which breaks the drops into fine droplets and disperses the fine droplets into misting volume 46. These fine droplets either work into brush roller 14 as it rotates through misting volume 46, or reach baffle 34, which causes the droplets to drip down onto the brush roller 14. Thus, the baffle 34 is provided to contain the solution may not be worked into the brush. Without the baffle 34, a fluid or solution may migrate around the shroud onto the floor, causing drip appearance problems and reduced cleaning performance. The baffle 34 promotes transmission of the solution into the brush and transfers fluid evenly across the width of the brush to the floor. The even distribution of cleaning liquid on brush roller 14 enhances the effectiveness of the surface maintenance or conditioning machine while reducing undesirable streaking, over-wetting, and other common problems associated with such machines.

In some embodiments, the baffle 34 extends to contact at least one brush roller 14, such that when the brush roller 14 is rotating contact between the bristles of brush roller 14 and the baffle 34 causes the baffle 34 to vibrate at high frequency. In such embodiments, baffle 34 acts as a second agitation blade in that it causes the cleaning liquid to re-disperse into misting volume 46 as fine droplets for even distribution on brush roller 14.

Figure 2A:
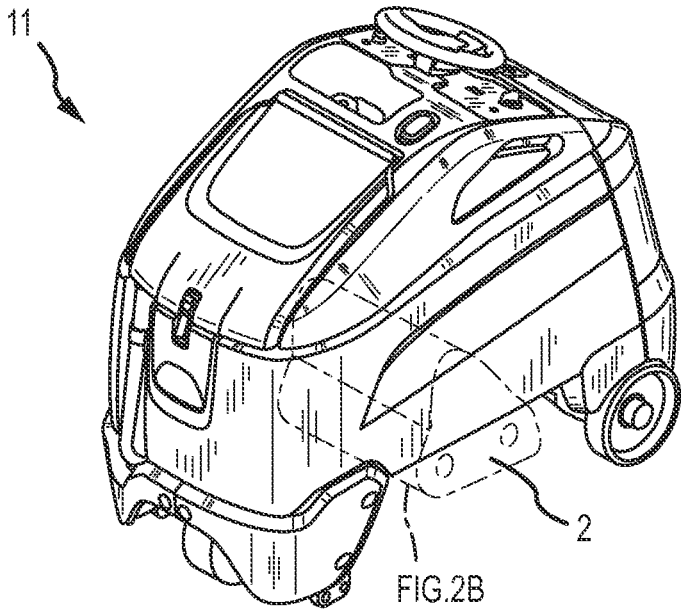
FIG. 2A is a perspective view a cleaning system according to one embodiment of the present disclosure.
Figure 2B:
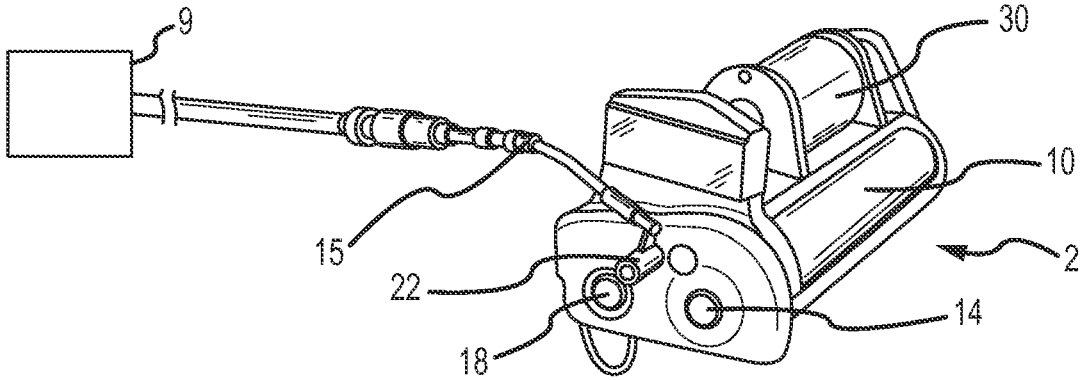
FIG. 2B is a perspective view of a surface cleaning device and solution distribution system according to an embodiment of the present disclosure.

FIG. 2A is a perspective view of a ride-on floor cleaning device according to one embodiment of the present invention. The floor cleaning device generally comprises a chassis 11 which receives, hosts, or carries a surface cleaning device 2 according to various embodiments. The surface cleaning device 2 is preferably provided on a lower or bottom surface of the device 11, and is shown and described in more detail in FIG. 2B.

FIG. 2 is a perspective view of a surface cleaning device 2 comprising a motor 30 and a shroud 10. The shroud and associated components, including brushes 14, 18 are shown as being removed from a chassis 11 of a cleaning machine for illustration purposes. The chassis 11 comprises a clean fluid storage tank 9 in fluid communication with the device 2 via at least one conduit 15. Fluid transmission from the tank 9 through the conduit 15 and to the device 2 is controlled by one or more user-operated controls and associated valves. For example, in one embodiment, a switch or user-interface is provided on a console associated with the chassis 11 for selectively activating and de-activating fluid transmission. In certain embodiments, fluid transmission may be activated and/or deactivated automatically and in response to related operations being activated or deactivated, such as movement of the brush rollers 14, 18. In various embodiments, the chassis comprises a movable chassis provided on wheels and adapted for receiving a user. Such a chassis is described in U.S. Pat. No. 8,528,142 to Pedlar et al., for example, the entire disclosure of which is hereby incorporated by reference in its entirety.

Figure 3:
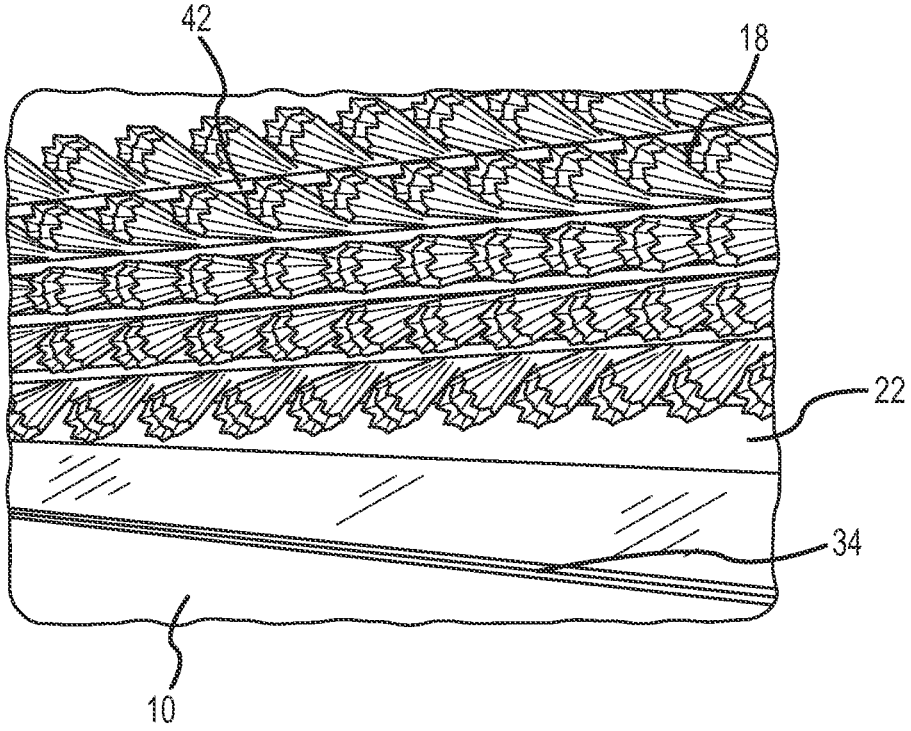
FIG. 3 is a detailed view of a roller brush according to one embodiment of the present disclosure.

In some embodiments, and as shown in FIG. 3, brush rollers 14, 18 are equipped with a dispersion strip 42. In such embodiments, the dispersion strip 42 extends across substantially the entire axial dimension of each brush roller 14, 18, and also extends outwardly from the body of each brush roller 14, 18 in the radial direction. The outer edge (in the radial direction) of dispersion strips 42 is located within the outer radius of brush rollers 14, 18, respectively; that is, dispersion strips 42 do not extend past the radial end of the bristles of brush rollers 14, 18, respectively. Dispersion strips 42 are preferably formed from rubber but in some embodiments are formed from materials other than rubber. In operation, dispersion strips 42 disperse drops of cleaning liquid that collect on the body of brush rollers 14, 18, thus further preventing uneven drops of cleaning liquid from falling on the surface being cleaned.

In some embodiments, the shroud 10 is movably attached to the body of the cleaning device 2 using a hinge or other mechanism, such that the side of shroud 10 can be opened for easy removal of counter-rotating brushes 14, 18 and/or other components of the gravity feed solution distribution system.

A gravity feed solution distribution system according to the present disclosure is useful with a variety of known surface conditioning and maintenance machines. For example, a gravity feed solution distribution system as described herein may be used with the floor cleaning apparatus described in U.S. Pat. No. 7,533,435, which is incorporated herein by reference. Brush rollers 14, 18 may be mounted on and/or in the shroud 10 using stationary (i.e. non-hinged) plates and steel spring clips. Such a mounting system is disclosed in the published United States Patent Application having Publication No. US 2006/0156498 A1, which is incorporated by reference herein.

Figure 4:
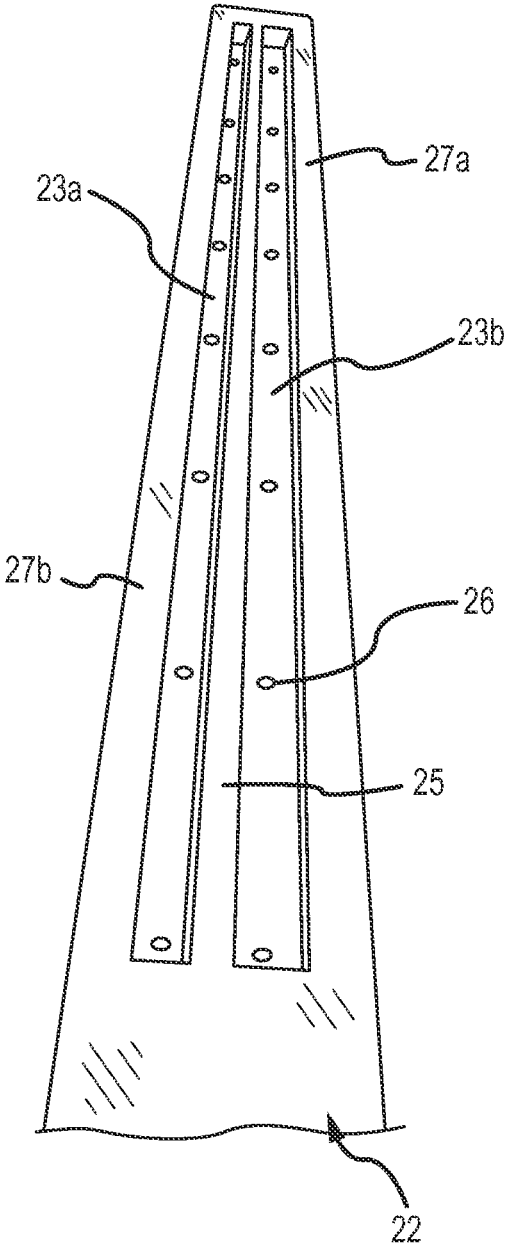
FIG. 4 is a perspective view of a manifold as used in an embodiment of the present disclosure.

FIG. 4 is a perspective view of a manifold 22 according to one embodiment the present invention. As shown, the manifold 22 comprises a pair of substantially parallel troughs 23*a*, 23*b*, and each of the troughs 23*a*, 23*b* comprise a plurality of ports 26 for allowing an egress of fluid from the trough. A partition 25 is provided and extends along a majority of the length of the manifold 22 to separate the two troughs 23*a*, 23*b*. In alternative embodiments, the manifold 22 is provided with as few as one trough, and as many as six parallel troughs.

Accordingly, the present invention is not limited to embodiments comprising a manifold 22 with two troughs 23*a*, 23*b* as shown in FIG. 4. Each trough 23*a*, 23*b* comprises a predetermined volume for collecting a fluid dispensed from additional system components. Where a flow rate of fluid from a fluid source is greater than a flow rate enabled by the ports 26, fluid is allowed to pool or collect in the troughs 23*a*, 23*b*. As pooling occurs, the fluid is distributed along the length of the manifold 22 such that fluid stored in the manifold 22 is dispensed through a plurality of different ports 26 located at different positions and thereby creating a more even fluid distribution along one or more associated rollers, which are preferably disposed beneath the manifold 22. The manifold further comprises at least one flange 27 and preferably two flanges 27*a*, 27*b* to allow the manifold 22 to operable as a removable tray. The flanges 27*a*, 27*b* provide for a contact and support surface and allow the manifold 22 to be slid out from a position use. This may be desirable when the manifold is to be cleaned or replaced, for example.

Figure 5:
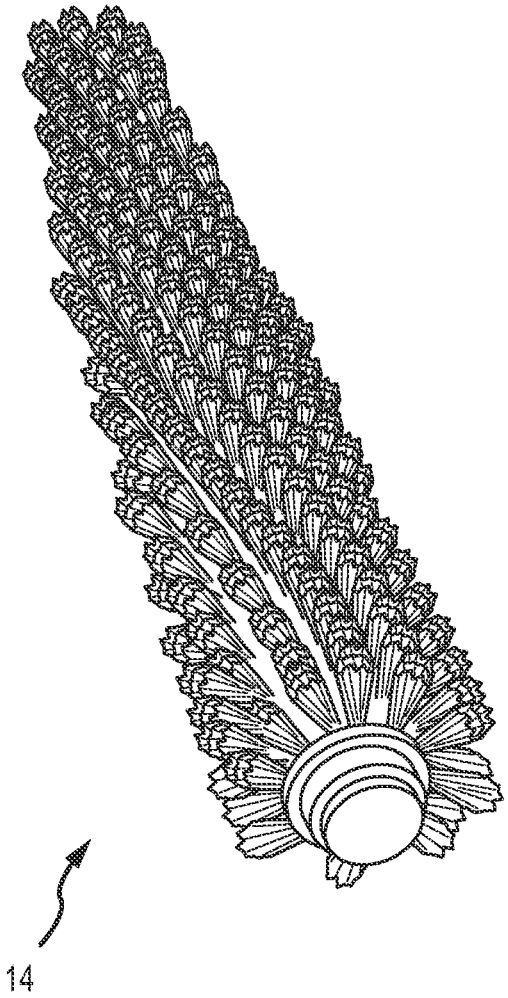
FIG. 5 is a perspective view of a brush roller as used in an embodiment of the present disclosure.

FIG. 5 is a perspective view of a brush roller 14 according to one embodiment of the present invention. As shown, the roller 14 comprises a plurality of radially protruding bristles adapted for contacting and cleaning a surface. In certain embodiments, the bristles are staggered around the periphery of the substantially cylindrical roller member 14.

Figures 6A, 6B:
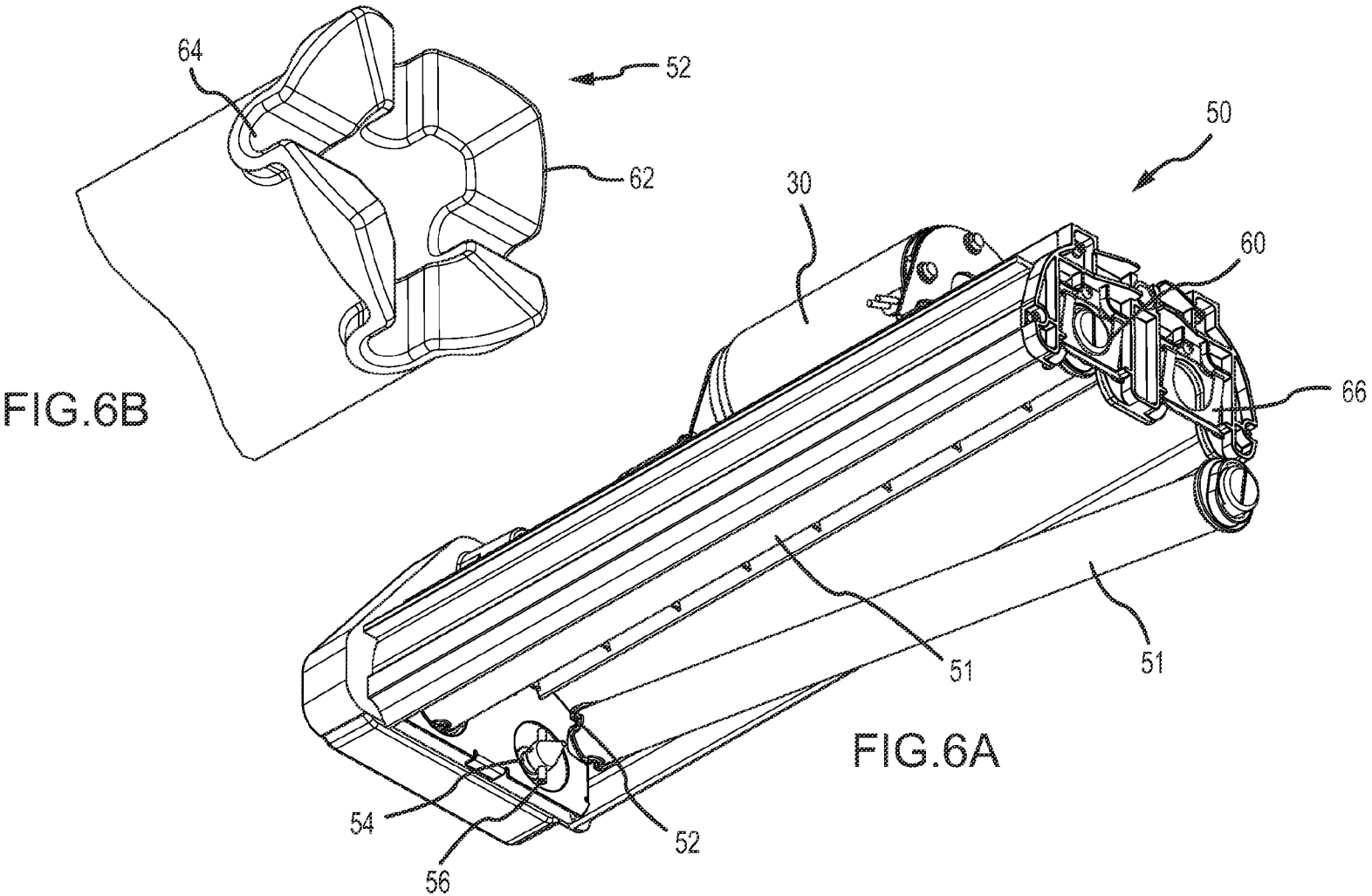
FIG. 6A is a bottom perspective view of a gravity feed solution distribution system with detached roller mechanism according to one embodiment of the present disclosure.
FIG. 6B is a detailed perspective view of one end of the roller mechanism provided in FIG. 6A.

FIGS. 6*a* and 6*b* provide perspective views of one embodiment of a shroud 50 comprising brush rollers 51. Brush rollers 51 are depicted without bristles, but it will be understood that rollers 51 may comprise any of a number of bristle arrangements or patterns. The shroud 50 comprises unique receiving features for selective connection of rollers 51 to the shroud and corresponding components. Specifically, brush drive shaft 54 is provided for receiving at least one end of the roller 51. The drive shaft 54 comprises a generally conical or tapered surface for receiving a corresponding surface or feature of a roller 51. It will be recognized, however, that draft shafts of the present disclosure are not limited to conical or frustoconical devices, although such arrangements constitute one design for aiding in insertion and connection of the roller 51. In various embodiments, the drive shaft 54 comprises at least one drive shaft cross-pin 56 for transferring torque to a roller 51. At least a portion of the drive shaft 54 and drive shaft cross-pin 56 are received by a female or driven end 52 of the roller 51. To aid in connection of the drive shaft 54 and roller 51, the driven end 52 of the roller comprises at least one drive slot 64 with at least one ramped surface 62 extending thereto. Ramped surfaces 62 aid in guiding the at least one drive shaft cross-pin 56 to a secured position within a drive slot 64.

A non-drive side 60 of the roller 51 is seated in a housing on the shroud 50, and may be secured thereto by a clip or similar fastener. Preferably, the non-drive side 60 of the roller 51 comprises a bearing surface, wherein force or torque imparted upon the drive side 52 causes the brush core to rotate and non-drive side 60 does not substantially impede such rotation. As shown in FIG. 6*a*, spring clips 66 are provided with one ramped end, such that a drive side 52 of the roller 51 may be installed/inserted, and the remainder of the roller 51 secured to the shroud 50 by moving the non-drive side of the roller upwardly until it snappingly engages the clip 66. In alternative embodiments, various clips are contemplated as comprising rotatable clips, latches, and clips that are selectively secured by one or more fasteners, to name a few. Preferably, however, the clip 66 provides at least some resistance to movement in a lateral direction such that a drive side 52 of the roller 51 is secured and/or biased toward the drive shaft 54 such that risk of dislocation between the roller 51 and drive shaft 54 is minimized or eliminated.

The embodiment depicted in FIGS. 6*a* and 6*b* provides four drive slots 64 and one drive shaft cross-pin 56 extending peripherally through the drive shaft 54. Such an arrangement provides enhanced user friendliness, as a roller should not need to rotate more than forty five degrees to be aligned with the nearest set of corresponding drive slots, and thus be properly installed. Various alternative embodiments, however, contemplate any number of drive shaft cross-pins 56 and related drive slots 64. Accordingly, the present invention is not limited to any particular number or arrangement of drive slots 64 and/or pins 56.

A method of installing a roller 51 is contemplated, the method comprising providing a brush roller 51 for installation with or into a shroud 50, installing a drive side 52 by mating the drive side 52 with a drive shaft 54 provided on one side of the shroud 50 and wherein mating is accomplished by securing at least one drive shaft cross-pin 56 within at least one drive slot 64 by providing an axial force on the roller 51. Subsequently, a non-drive side of the roller 51 is secured at a second end. Securing the second end may be accomplished, for example, by rotating the roller 51 about a point proximal to the drive shaft 54 until the non-drive side is secured within the shroud 50 and allowed to rotate substantially freely therein. Removal of a roller 51, such as may be required for maintenance or replacement, is accomplished by conducting substantially the same sequence in reverse.

Preferably, a plurality of drive slots 64 and ramped surfaces 62 are provided on the drive-side 52 of the brush 51. The provision of such a plurality aids in installation, particularly in applications where an installer has limited visibility, such as when installing rollers under the deck of a large floor cleaning or treatment device.

Power and/or torque is transmitted to drive shaft 54 and any interconnected rollers 51 by, for example, an on-board power source such an engine or motor and associated components such as drive belts, pulleys, etc. (not shown).

Although a preferred embodiment provides a substantially conical drive shaft with at least one transverse cross-pin for driving a roller, various alternative embodiments are contemplated. The present disclosure contemplates a system comprising a drive member and a roller, the roller being selectively attachable to the drive member and the system comprises user-friendly features to facilitate such attachment. Accordingly, various embodiments are within the scope and spirit of the present disclosure. For example, various embodiments of the present disclosure contemplate various systems wherein at least one of a brush roller and a drive member comprise at least a male projection and the opposing device comprises at least a female member. In further embodiments, a brush roller and a drive member comprise both male and female components adapted for force-transmitting communication with one another. For example, a roller and a drive member of one embodiment each comprise toothed or geared projections for engaging each other in force-transmitting communication. At least one conical member is provided on one or both members to guide and ease attachment of the members.

Figure 7A:
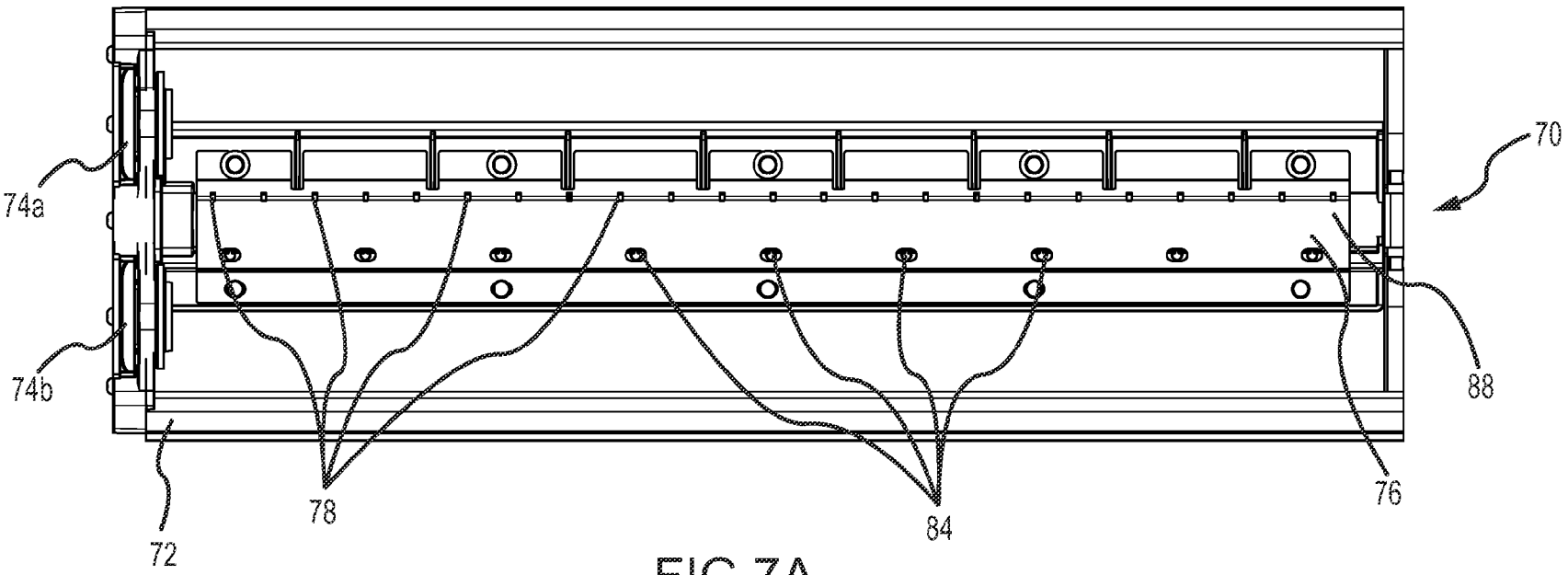
FIG. 7A is a top view of a surface cleaning device according to one embodiment of the present disclosure.

FIG. 7A is a top cross-sectional view of a surface cleaning device 70 according to one embodiment. As shown, roller attachment members 74*a*, 74*b* are provided for receiving and end of a roller (not shown). A shroud 72 is provided to at least partially surround additional components and prevent unwanted entrance of objects into the area defined by the shroud 72, as well as contain fluid and debris within the area. A manifold 86 is provided and extends along a width of the shroud 72. The manifold 76 comprises a plurality of fluid ports 84 for dispensing fluid to areas and features located vertically below the manifold 76. A distribution baffle 88 is provided proximal to the manifold 76. The distribution baffle 88 receives gravity-fed fluid from the manifold 76. The distribution baffle 88 comprises a plurality of distribution ports 78 for further dispensation of fluid onto one or more rollers.

Figure 7B:
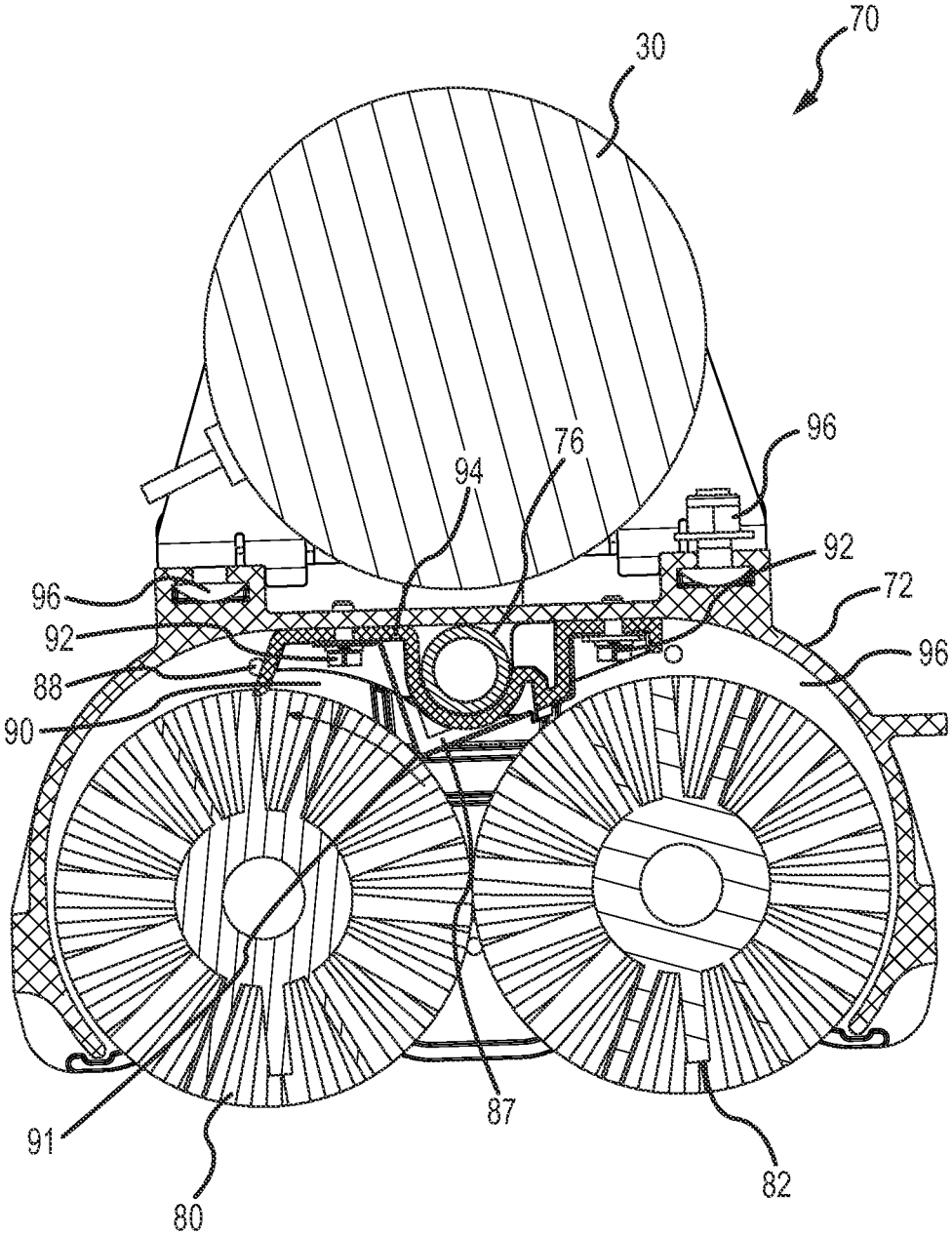
FIG. 7B is a cross-sectional elevation view of a surface cleaning device and solution distribution system according to an embodiment of the present disclosure.

FIG. 7B is a cross-sectional elevation of the surface cleaning device 70 of the embodiment of FIG. 7A. As shown, the device 70 comprises a shroud 72 for defining an at least partially enclosed space 96. A pair of brush rollers 80, 82 are provided at least partially within the space 96 and preferably a portion of the rollers 80, 82 extend beyond the space 96 for contacting a surface such as a carpet or floor. A manifold 76 is provided within the shroud 72 and preferably above and/or between the rollers 80, 82. As shown in FIG. 7B, a manifold 76 according to at least some embodiments comprises a substantially circular cross-section and spans at least a portion of a longitudinal dimension of the brush(es) 80, 82. In certain embodiments, the manifold 76 spans at least approximately fifty percent of the length of a brush. In more preferred embodiments, the manifold 76 spans at least approximately eighty percent of the length of the brush. Further provided within the shroud 72 is a baffle 94. The baffle 94 may be secured to the shroud 72 by one or more known fasteners 92. Although the baffle 94 is described herein as being a single component, the baffle 94 further comprises various features for performing various functions as shown and described herein. As shown, the baffle 94 surrounds and supports the manifold 76. The baffle 94 extends outwardly in multiple directions from the manifold 76 and comprises a containment baffle 88 at at least one end thereof. The containment baffle 88 comprises a resilient extension member positioned for communication with at least one roller 80. Such communication or contact with bristles of the roller 80 agitates the bristles as they pass the containment baffle 88 and prevents excess solution not contained in the brush from transferring to the shroud 72. This reduces unwanted build-up of fluid within the shroud space 96 and prevents streaking or uneven distribution of materials or fluid. The resilient extension member 88 partially bounds an area 90 for containing misted or distributed fluids within a substantially confined space proximal to the brush 80.

The baffle 94 further comprises a distribution baffle 91 which extends downwardly from the manifold 76 and the remainder of the baffle 94. In certain embodiments, the distribution baffle 91 extends along a length of the brush and comprises a plurality of ports (84 in FIG. 7A) for transmitting a fluid to one or more brushes 80, 82. As seen in the cross-sectional side view of FIG. 7B, the distribution baffle 91 comprises a trough 87 or low point of gravitational potential energy to which fluid is conveyed. The ports 84 are distributed along this trough such that collected or pooled fluid is allowed to drain through the ports 84 and to the underlying structure (s). In preferred embodiments, the ports 84 and distribution ports 78 are staggered to achieve a desired flow rate of fluid. In one embodiment, approximately twenty three distribution ports 78 are provided and approximately nine ports 84 are provided. It will be recognized, however, that the distribution and number of ports 84 and distribution ports 78 may be varied without deviating from the scope and spirit of the present invention.

While various embodiments of the present disclosure have been described in detail herein, it is apparent that modifications and alterations of those embodiments will occur to those skilled in the art. However, it is to be expressly understood that such modifications and alterations are within the scope and spirit of the present disclosure, as set forth in the following claims. Further, the invention(s) described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as additional items.

What is claimed is:

1. A gravity feed solution distribution system for a surface cleaning device, the system comprising:

a shroud defining an at least partially enclosed space;

a first brush roller disposed at least partially within the shroud, the first brush roller rotatable in a clockwise direction about a first axis;

a second brush roller disposed at least partially within the shroud, the second brush roller rotatable in a counter-clockwise direction about a second axis, the second axis being substantially parallel to the first axis;

a selectively removable manifold in the form of a removable tray having a plurality of fluid delivery ports spaced along a length of the manifold, the manifold being disposed above the first and second brush rollers;

an agitation member extending beneath the manifold and provided proximal to at least one of the first brush roller and the second brush roller, the agitation member provided in force transmitting communication with at least one of the first and second brush rollers to enhance distribution of a solution in the system; and a baffle extending along substantially the entire transverse dimension of the shroud and into the at least partially enclosed space, the baffle further positioned above and in contact with at least one of the first and second brush rollers and positioned to confine sprayed solution to an area above at least one of the first and second brush rollers.

2. The gravity feed solution distribution system of claim 1, further comprising a motor in operable communication with at least one of the first and second brush rollers.

3. The gravity feed solution distribution system of claim 1, further comprising a wheel-driven chassis for selective conveyance of the system.

4. The gravity feed solution distribution system of claim 1, wherein the manifold comprises first and second substantially parallel troughs.

5. The gravity feed solution distribution system of claim 1, wherein the plurality of fluid delivery ports are spaced evenly along a length of the manifold.

6. A gravity feed solution distribution system for a surface cleaning device, the system comprising:

a movable chassis comprising at least two wheels;

the chassis comprising a shroud defining an at least partially enclosed space, the shroud adapted to prevent unwanted conveyance of a fluid;

a first brush roller disposed at least partially within the shroud, the first brush roller rotatable in a clockwise direction about a first axis;

a second brush roller disposed at least partially within the shroud, the second brush roller rotatable in a counter-clockwise direction about a second axis, the second axis being substantially parallel to the first axis;

a clean fluid storage tank positioned at a location of greater gravitational potential energy than the first brush roller and the second brush roller;

a resilient extension member provided proximal to at least one of the first brush roller and the second brush roller, wherein the resilient extension member contacts a portion of at least one of the first brush roller and the second brush roller at least once per revolution of the brush roller; and a baffle member extending along a transverse dimension of the shroud and into the at lest partially enclosed space, the baffle positioned above at least one of the first and second brush rollers and positioned to confine sprayed solution to an area above at least one of the first and second brush rollers.

7. The gravity feed solution distribution system of claim 6, wherein the shroud comprises a baffle to contain fluid and maintain the contained fluid proximal a periphery of at least one of the first brush roller and the second brush roller.

8. The gravity feed solution distribution system of claim 6, wherein the first brush rollers comprises a plurality of radially extending bristles, each of said radially extending bristles provided in force-transmitting communication with the resilient extension at least once per rotation of the first brush roller.

9. The gravity feed solution distribution system of claim 6, further comprising a motor in operable communication with at least one of the first and second brush rollers.

10. The gravity feed solution distribution system of claim 6, further comprising a fluid collection tray for receiving a fluid from the clean fluid storage tank.

11. The gravity feed solution distribution system of claim 10, wherein the fluid collection tray comprises a plurality of ports permitting a fluid to drain from the fluid collection tray under the force of gravity.

12. A gravity feed solution distribution system for a surface cleaning device, the system comprising:

a chassis comprising at least two wheels;

the chassis comprising a shroud defining an at least partially enclosed space, the shroud adapted to prevent unwanted conveyance of a fluid;

a brush roller disposed at least partially within the shroud, the brush roller rotatable about an axis, the axis being substantially parallel to a surface to be cleaned;

the brush roller comprising a plurality of bristles extending from the brush roller, the plurality of bristles defining a circumference of the brush roller;

a clean fluid storage tank positioned at a location of greater gravitational potential energy than the brush roller;

a fluid distribution and containment system comprising: a selectively removable fluid collection tray for receiving a fluid from the clean fluid storage tank, the fluid collection tray comprising at least one flange as a support surface for the fluid collection tray, first and second parallel troughs for receiving fluid, and a plurality of ports for conveying gravity-fed fluid from the tray to the brush roller; and a resilient extension member extending into the circumference such that when the brush roller is rotated the plurality of bristles contact the resilient extension member and a fluid on the brush roller is agitated.

13. The gravity feed solution distribution system of claim 12, further comprising a second brush roller rotatable about a second axis, the second axis being substantially parallel to the axis.

14. The gravity feed solution distribution system of claim 13, wherein the brush roller is rotatable about the axis in a first direction and wherein the second brush roller is rotatable about the second axis in a second direction, the second direction being opposite to the first direction.

15. The gravity feed solution distribution system of claim 12, wherein the shroud comprises a baffle to contain fluid and maintain the contained fluid proximal a periphery of the brush roller.

16. The gravity feed solution distribution system of claim 12, further comprising a motor in operable communication with the brush roller.

17. The gravity feed solution distribution system of claim 12, wherein the at least one flange is slidable with respect to the system such that the fluid collection tray is selectively removable from the system.

* * * * *